United States Patent [19]

Wang

[11] Patent Number: 4,655,444

[45] Date of Patent: Apr. 7, 1987

[54] HOLDER FOR STRINGING A RACKET

[75] Inventor: Chieh-Shan Wang, Kaohsiung, Taiwan

[73] Assignee: Exthree Industrial Co., Ltd., Kaohsiung, Taiwan

[21] Appl. No.: 848,966

[22] Filed: Apr. 7, 1986

[51] Int. Cl.[4] ..... B25B 5/14

[52] U.S. Cl. ..... 269/156; 269/296

[58] Field of Search ..... 269/155, 156, 296–301

[56] References Cited

U.S. PATENT DOCUMENTS 1,888,800 11/1932 Grothe ..... 269/156
3,735,973 5/1973 Petrie ..... 269/296
4,049,254 9/1977 Godot ..... 269/156
4,548,392 10/1985 Rickling ..... 269/156

*Primary Examiner*—Frederick R. Schmidt
*Assistant Examiner*—Judy J. Hartman
*Attorney, Agent, or Firm*—Browdy and Neimark

[57] ABSTRACT

A holder for stringing a racket includes a base, an intermediate fitted in the base, two holding arms having their one ends respectively pivotally mounted on the two sides of the intermediate, a screw threadedly engaging with the base and the intermediate for forcing the holding arms in inward or outward movement to hold or release the frame portion of a racket, and a clamping piece which together with holding arms clamps the frame portion therebetween.

4 Claims, 6 Drawing Figures

HOLDER FOR STRINGING A RACKET

BACKGROUND OF THE INVENTION

The present invention relates to a holder for stringing a recket, and more particularly to a holder holding the frame portion of a racket at more than two points.

The prior holder for stringing a racket, as shown in FIG. 1, which is referred to as two points-type, includes two roughly U-shaped supporting plates 10 on which there are provided with two adjusting nuts for holding the frame portion of a racket at its fore and rear edges respectively. Since upon stringing, the pulling force exerted on the string is 60–80 pounds, a transverse deformation will occur when stringing in the longitudinal (fore-and-rear) direction of the frame portion owing to the fact that the transverse direction thereof does not have been provided with any holding measures.

In an effort to dealing with the above shortcoming, as shown in FIG. 2, a six points-type holder had been proposed which in addition to the provisions of two roughly U-shaped supporting plates 20 together with two adjusting nuts, includes two pairs of movable screw clampers 21 for the prevention of the frame portion from the above said deformation. However, since screw clampers 21 are manually operated, it is difficult, or even impossible, to have each screw clamper 21 evenly force-applied which thus, still results a deformation of the frame portion. Furthermore, the attemp to evenly apply a clamping force on each screw clamper 21 is time-consuming. In addition, with screw clampers 21 acting as obstacles, stringing operation for the frame portion is interrupted. It is therefore tried by the applicant to deal with the above described situation.

SUMMARY OF THE INVENTION

It is therefore an object of the present invention to provide a holder for stringing a racket which can prevent the frame portion of the racket from deformation and is easy and quick in operation.

In accordance with one aspect of the present invention, a holder for stringing a racket includes a base, an intermediate fitted in the base, two holding arms having their one ends respectively pivotally mounted on the two sides of the intermediate, and a screw threadedly engaging with the base and the intermediate for forcing the holding arms in inward or outward movement to hold or release the frame portion of the racket.

In accordance with further an aspect of the present invention, a holder for stringing a racket further includes a clamping piece which together with holding arms clamps the frame portion therebetween.

The present invention may best be understood by referring to the description hereinafter with reference to the accompanying drawings, in which:

DETAILED DESCRIPTION

Figure 1:
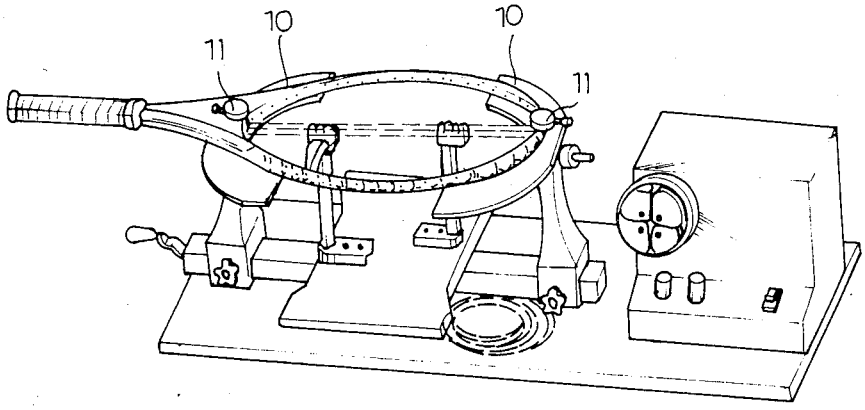
FIG. 1 is a perspective view showing a two points-type holder for stringing a racket of the prior art.
Figure 2:
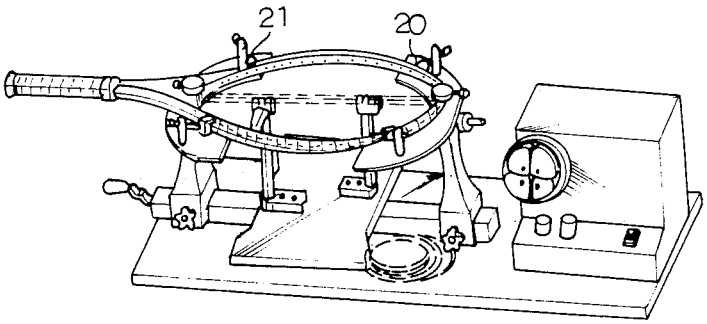
FIG. 2 is a perspective view showing a six points-type holder for stringing a racket of the prior art.
Figure 3:
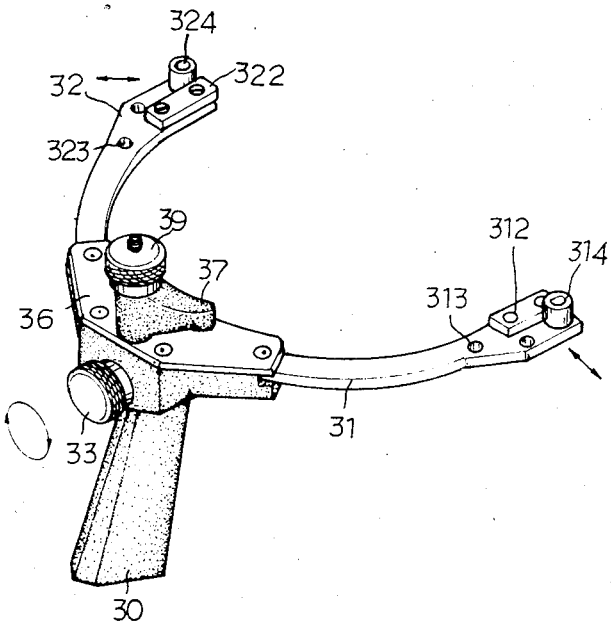
FIG. 3 is a perspective view showing a preferred embodiment of a holder for stringing a racket according to the present invention.
Figure 4:
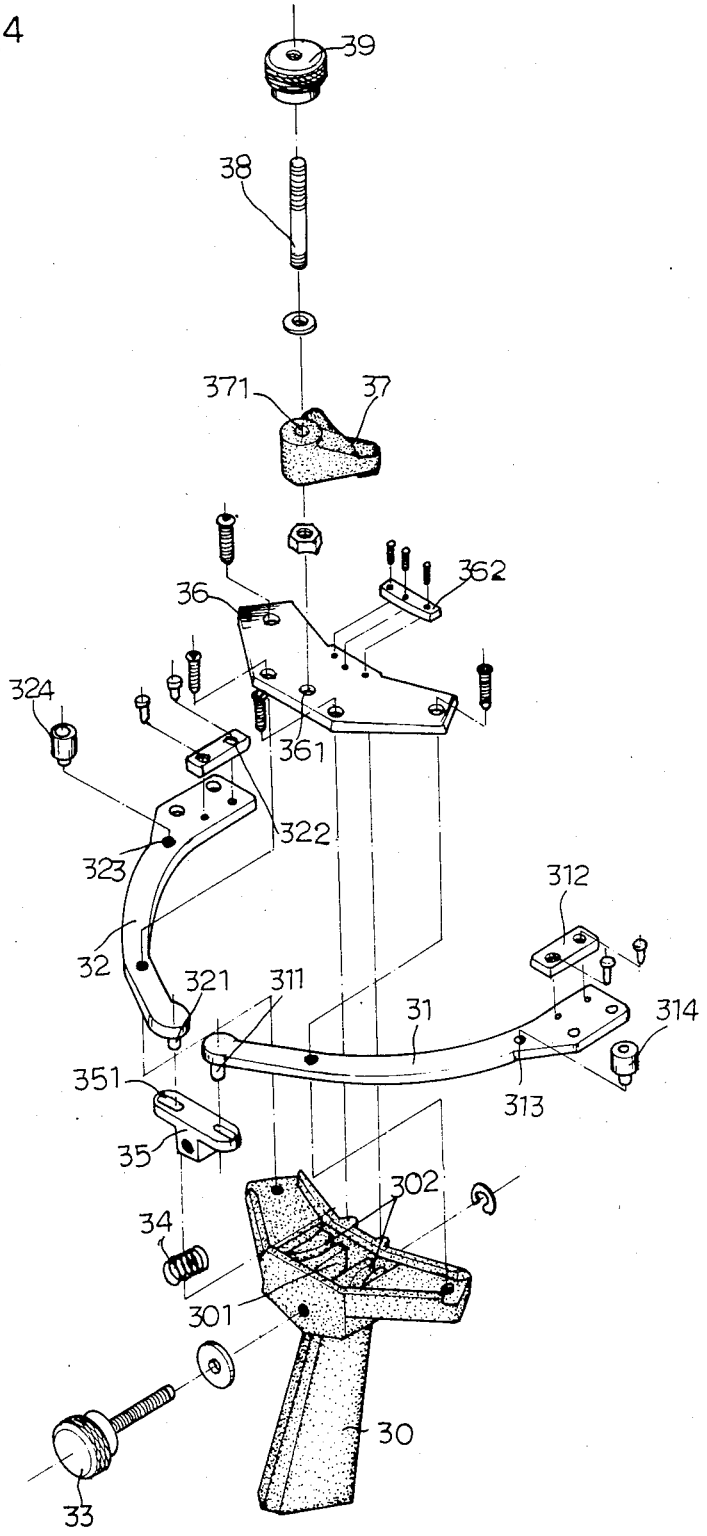
FIG. 4 is an exploded view showing a holder for stringing a racket of the present invention.

Referring now to FIGS. 3 and 4, a holder for stringing a racket according to the present invention includes a base 30, a pair of holding arms 31, 32, a mounting plate 36 and a clamping piece 37. Base 30 includes at the top thereof two arc grooves 302 and a central groove 301 which locates between grooves 302 and receives therein an intermediate 35 and a spring 34. An adjusting screw 33 passes through base 30, spring 34 and intermediate 35 which at the two sides thereof includes two arc slots 351 respectively. Holding arms 31, 32 at one ends thereof respectively include two lugs 311, 321 which respectively engages in slots 351, are confined between mounting plate 36 and base 30 by two screws screwing through mounting plate 36, holding arms 31, 32 and into base 30, and at the other ends thereof respectively fix thereon two raisers 312, 322 which together with mounting plate 36 support the frame portion in a plane, and respectively include three holes 313 and three holes 323 each ones of both of which are respectively capable of receiving therein two shafted rollers 314, 324 which hold the frame portion tightly when holding arms 31, 32 move inwardly. With the provision of a nut 39, a both-ends-threaded bolt 38 passing through clamping piece 37 and screwed on a threaded hole 361 on mounting plate 36 can have the frame portion clamped between clamping piece 37 and a raiser 362 secured on mounting plate 36.

Figure 5:
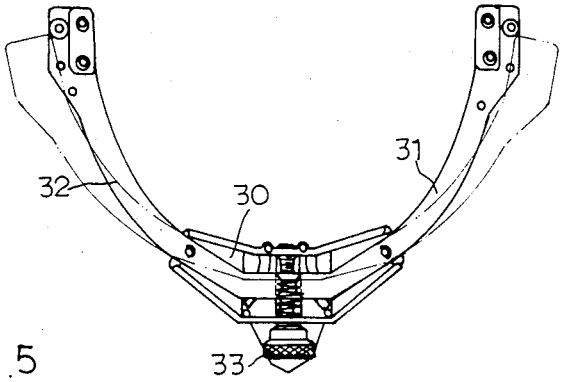
FIG. 5 is a schematical view showing the simultaneous inward or outward movement of two holding arms of a holder of the present invention.
Figure 6:
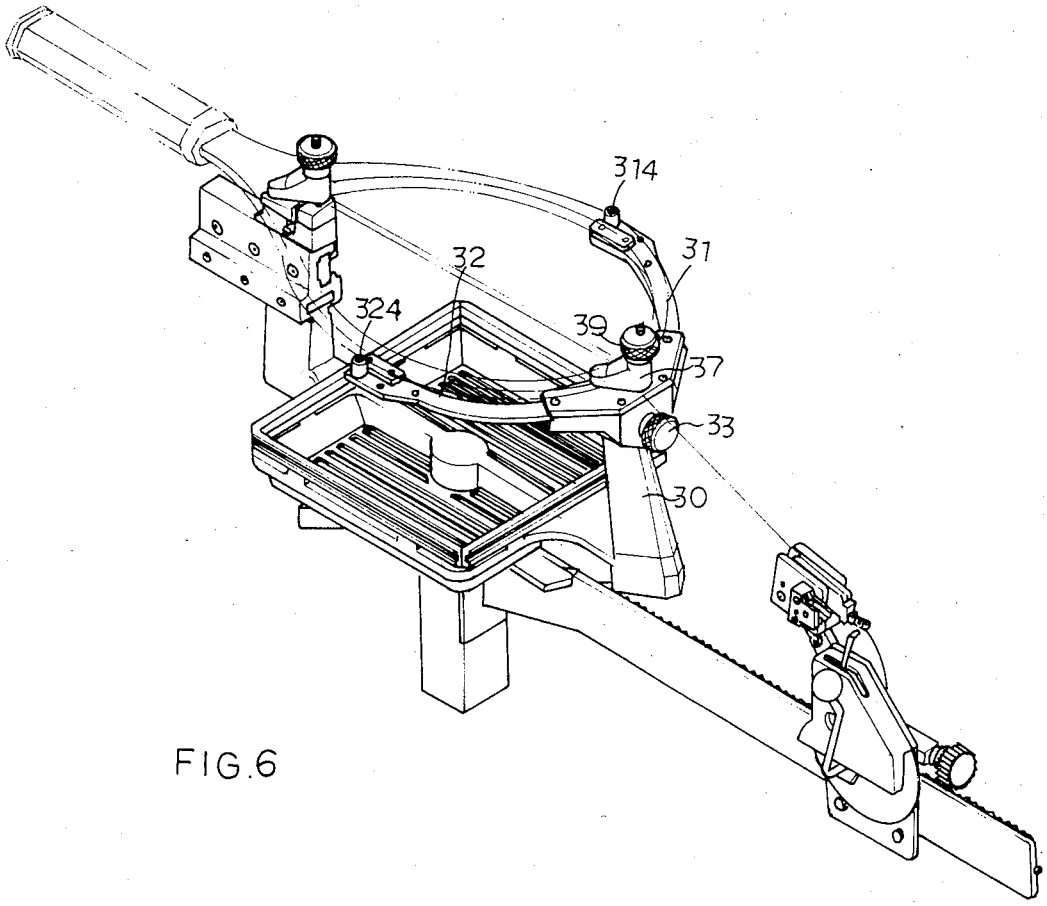
FIG. 6 is a perspective view showing a holder for stringing a racket of the present invention in working.

Referring to FIGS. 5 and 6, the operation of the present holder is briefly summarized as follows:

At the very beginning, the clamping piece at the rear edge of the frame portion is removed and nut 39 is rotated to have clamping piece 37 at the fore edge of the frame portion loose. Then, clamp the fore edge of the frame portion between mounting plate 36 and clamping piece 37 by adjusting the respective nut 39. Subsequently, the rear edge is clamped in a similar manner. Depending upon the size of the frame portion, the shafted rollers 314, 324 are respectively mounted in ones of hloes 313 and holes 323. Then, by screwing on adjusting screw 33, intermediate 35 will inwardly move the two holding arms 31, 32 simultaneously to hold tightly the frame portion.

The advantages of the present holder are as follows:

(1) Holding arms 31, 32 are simultaneously moved and therefore an even force application is guaranteed.

(2) Transverse deformation of the frame portion is limited by sideward holding measures provided by shafted rollers 314, 324 mounted in holes 313, 323.

(3) The operation thereof is easy and quick.

(4) With shafted rollers 314, 324 capable of being mounted in ones of holes 313 and holes 323 respectively, the present holder can effectively hold the frame portion of various size.

(5) With a uniform holding force on the frame portion and effective sideward deformation-preventing measures, the quality of the racket thus produced is assured and every such racket is eligible for being marketed.

What I claim is:

1. A holder for stringing a racket comprising:

a base having at the top thereof two arc grooves and a central groove positioned between said arc grooves;

an intermediate received in said central groove and having at the two sides thereof two slots which overlap said arc grooves respectively;

a spring received in said central groove;

an adjusting screw having an actuating means screwing through said base, said spring and said intermediate;

two holding arms having at the one ends thereof two lugs respectively which respectively engages in said respective slots and arc grooves;

a mounting plate together with said base for confining said holding arms therebetween in a direction perpendicular to the adjusting screw axis; and a clamping piece adapted to be controlled by a both-ends-threaded bolt and a nut for being capable of cooperating with said mounting plate for clamping the frame portion of said racket therebetween, so that when said adjusting screw is actuated, said intermediate will be moved against the force of the spring which in turn will simultaneously move said holding arms inwardly.

2. A holder for stringing a racket according to claim 1, further comprising two shafted rollers and wherein said holding arms have the other ends thereof attached to two raisers respectively which together with said mounting plate support said frame portion in a plane, and further provided with three holes respectively every one of which is capable of mounting therein one of said shafted rollers so that said holder can hold the frame portion of various size by positioning said one shafted roller on one of said three holes.

3. A holder for stringing a racket according to claim 1 wherein a raiser is attached to said mounting plate which cooperates with said clamping piece to clamp said frame portion therebetween.

4. A holder for stringing a racket according to claim 1 wherein the distance between said two arc grooves along the axis of said adjusting screw is getting larger in the direction approaching the actuating means of said adjusting screw.

* * * * *